US006776073B1

(12) United States Patent
Brady et al.

(10) Patent No.: US 6,776,073 B1
(45) Date of Patent: Aug. 17, 2004

(54) HAND PLIERS

(75) Inventors: Robert O. Brady, Sarasota, FL (US); Joel R. Chartier, Bradenton, FL (US)

(73) Assignee: Role Associates, LLC, Sarasota, FL (US)

( * ) Notice: Subject to any disclaimer, the term of this patent is extended or adjusted under 35 U.S.C. 154(b) by 0 days.

(21) Appl. No.: 10/336,051

(22) Filed: Jan. 3, 2003

(51) Int. Cl.[7] ..... B25B 7/00
(52) U.S. Cl. ..... 81/427.5; 81/900; 81/416
(58) Field of Search ..... 81/427.5, 900, 81/177.1, 415–416, 489, 318, 339–341

(56) References Cited

U.S. PATENT DOCUMENTS

| | | | | | |
|---|---|---|---|---|---|
| 611,537 | A | * | 9/1898 | Ward | 81/416 |
| 1,231,167 | A | * | 6/1917 | Jones | 81/416 |
| 2,701,487 | A | * | 2/1955 | Ortman | 81/331 |
| 4,023,450 | A | | 5/1977 | Ygfors | |
| 4,185,523 | A | | 1/1980 | Kreitz | |
| 5,865,077 | A | | 2/1999 | Moffitt, Jr. | |
| 5,987,750 | A | * | 11/1999 | Tally | 30/92 |
| 6,202,518 | B1 | | 3/2001 | Moffitt, Jr. | |
| 6,558,548 | B2 | * | 5/2003 | Svirklys et al. | 210/603 |

* cited by examiner

*Primary Examiner*—Debra S. Meislin
(74) *Attorney, Agent, or Firm*—Charles J. Prescott

(57) ABSTRACT

A pair of non-conductive substantially buoyant-in-water hand pliers comprising a pair of non-conductive lever members each having a handle portion and a jaw portion and formed of material having a density greater than water. The lever members are pivotally connected together at common central portions between the jaw and handle portions. Each handle portion has one or more outwardly opening cavities formed into a side surface of the handle portions. An elongated tubular sheath formed of material buoyant in water covers and sealingly encloses the cavity whereby the effective density of the pliers to less than that of water. A restraining detent providing felt indicia and limiting opening pivotal movement between the jaw portions to reduce the likelihood of damage is also provided.

27 Claims, 14 Drawing Sheets

HAND PLIERS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to hand tool construction, and more particularly to a lightweight non-conductive pair of pliers having water buoyant characteristics and protective detent and restraint aspects for use by fishermen and boaters and others using such tools in the vicinity of water and/or electricity.

2. Description of Related Art

Boaters and fishermen and others who use hand tools in the vicinity of water are notorious for dropping hand tools irretrievably into the water. If the tool happens to be fabricated of metallic material, magnets may be used at the end of a long flexible line to afford some chance of retrieval. Additionally, use of metallic hand tools around salt water will quickly cause substantial, detrimental corrosion in the form of surface rust on such hand tools.

A broader concern for users of such hand tools is with respect to the presence of water on the ground or floor surface or carelessness while using a conductive hand tool around sources of electric power and energized wiring and connectors therefor.

To address the issue of buoyancy in water, Kreitz teaches a set of floating pliers in U.S. Pat. No. 4,185,523 wherein a block of closed cell polymeric foam is inserted between the handle portions of the lever members to provide sufficient flotation to render the pliers buoyant and also to provide a resilient automatic jaw opening mechanism during use.

In U.S. Pat. No. 5,865,077, Moffitt discloses floating, non-conductive hand tools in the form of pliers or channel locks which utilize nonconductive lever members pivotally connected together. Water buoyancy is achieved either by entrapping gas or air within a sealed airtight hollow cavity formed within the handle portion of each lever member by special manufacturing methods and apparatus and/or by providing a closed-bottomed sheathing material having a low density substantially below that of water fitted over the end of the handle portion of each lever member. A further enhancement of that disclosure by Moffitt is shown in U.S. Pat. No. 6,202,518 which additionally teaches wear resistant removable jaw members and a line cutter interconnected to one of the handle portions of one lever member thereof.

Pliers made from a plastic material are disclosed in U.S. Pat. No. 4,023,450 invented by Ygfors whose basic object is to produce pliers suitable for picking up small objects.

The present invention discloses a light weight non-conductive, substantially non-corrosive water buoyant pair of pliers which achieves water buoyancy through the cooperative effects of an elongated low density sleeve open at each end thereof and fitted over the handle portions of each lever member to sealingly enclose one or more open air cavities formed in outwardly opening fashion into each handle portion. Additionally, an advisory detent and physical restraint to excessive jaw portion opening, which, if opened there beyond to receive an object which is held between the jaws by the manual squeezing together of the handle portions could lead to pliers damage, is also provided.

BRIEF SUMMARY OF THE INVENTION

This invention is directed to a pair of non-conductive substantially buoyant-in-water hand pliers comprising a pair of non-conductive lever members each having a handle portion and a jaw portion and formed of material having a density greater than water. The lever members are pivotally connected together at common central portions between the jaw and handle portions. Each handle portion has one or more outwardly opening cavities formed into a side surface of the handle portions. An elongated tubular sheath formed of material buoyant in water covers and sealingly encloses the cavity whereby the effective density of the pliers to less than that of water. A restraining detent providing felt indicia and limiting opening pivotal movement between the jaw portions to reduce the likelihood of damage is also provided.

It is therefore an object of this invention to provide a lightweight non-conductive pair of pliers having buoyancy in water.

It is another object of this invention to provide a substantially non-corrosive pair of pliers which are substantially water buoyant, particularly in salt water.

Still another object of this invention is to provide a non-conductive, non-corrosive pair of pliers which achieves buoyancy in water by the cooperative effect of outwardly opening cavities formed into the handle portion which are sealably covered by an elongated tubular sheath formed of low density foam material.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
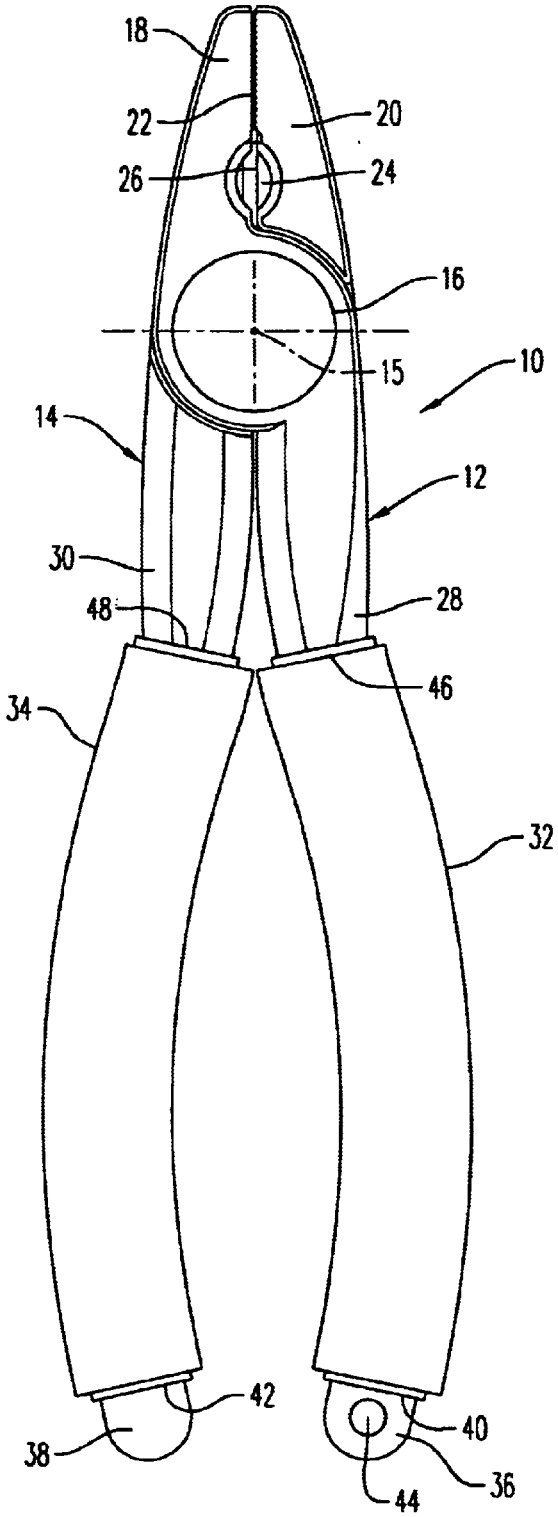
FIG. 1 is a front elevation view of one embodiment of the invention.
Figure 2:
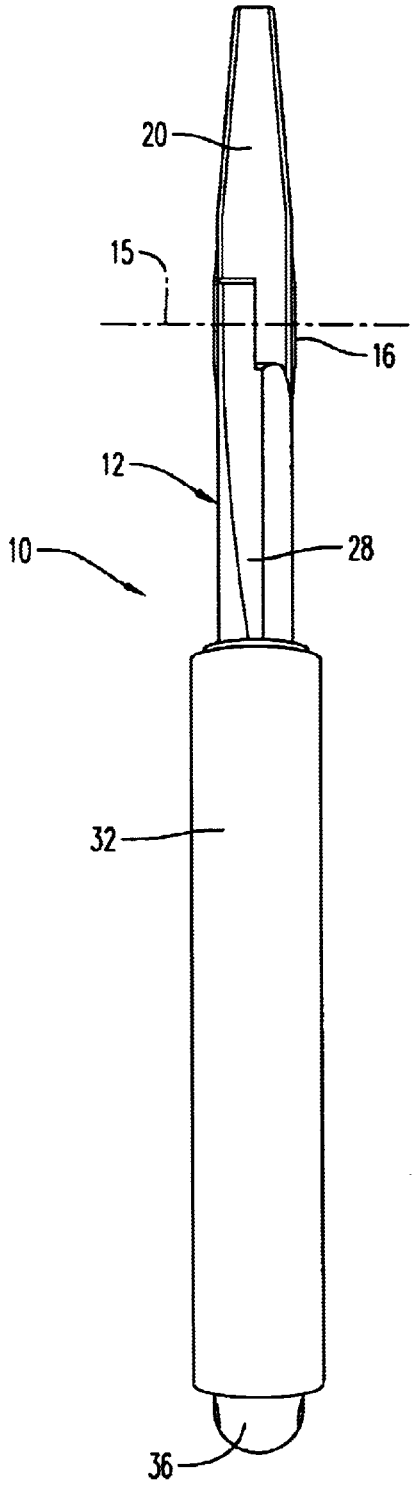
FIG. 2 is a side elevation view of FIG. 1.
Figure 3:
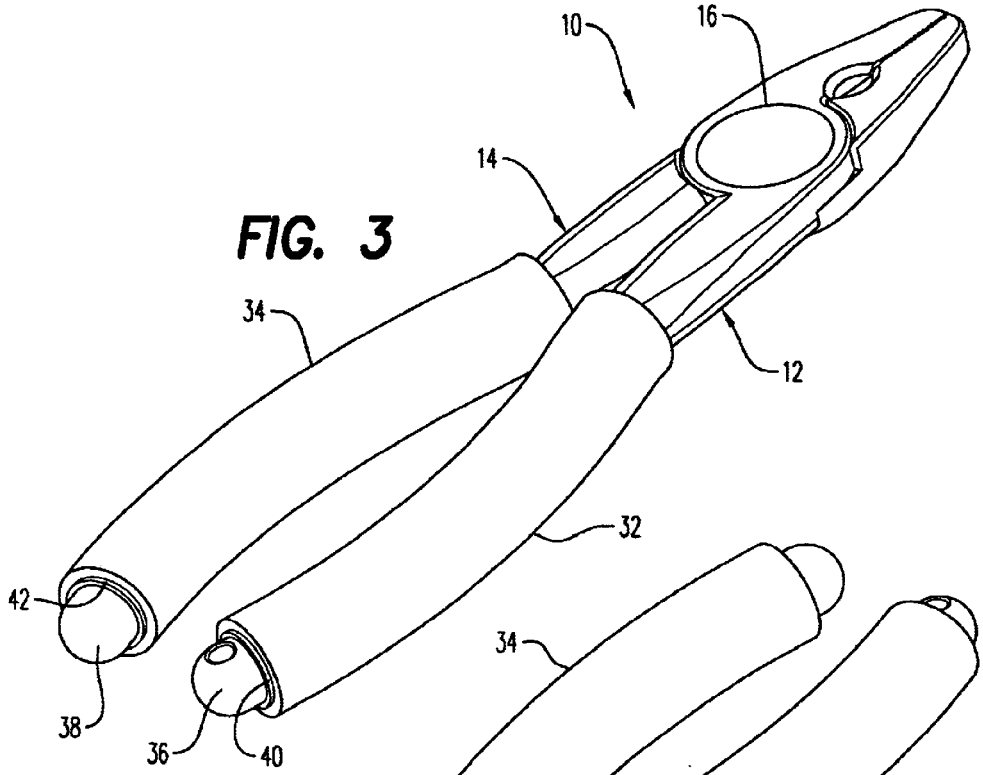
FIG. 3 is a perspective view of the invention shown in FIG. 1.
Figure 4:
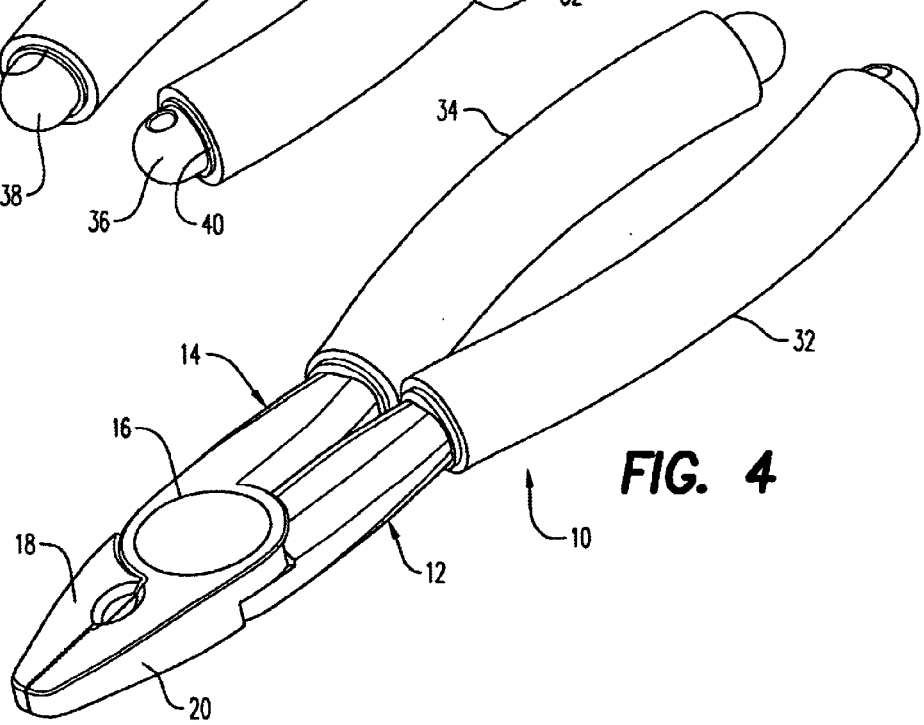
FIG. 4 is another perspective view of the invention shown in FIG. 1.
Figure 5:
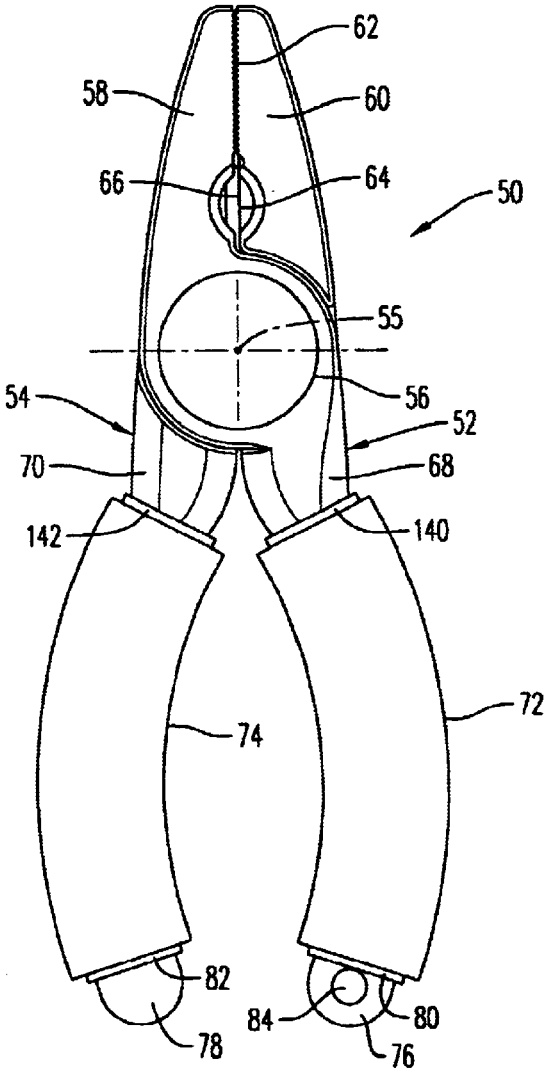
FIG. 5 is a front elevation view of another embodiment of the invention.
Figure 6:
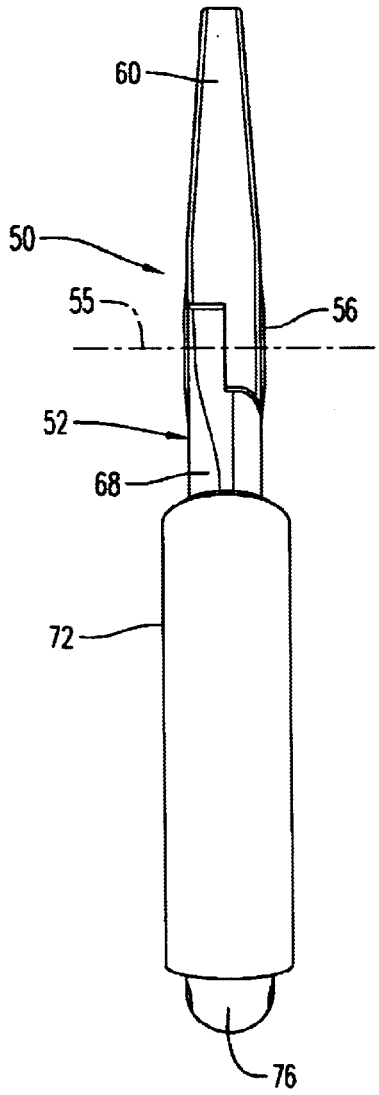
FIG. 6 is a side elevation view of FIG. 5.
Figure 7:
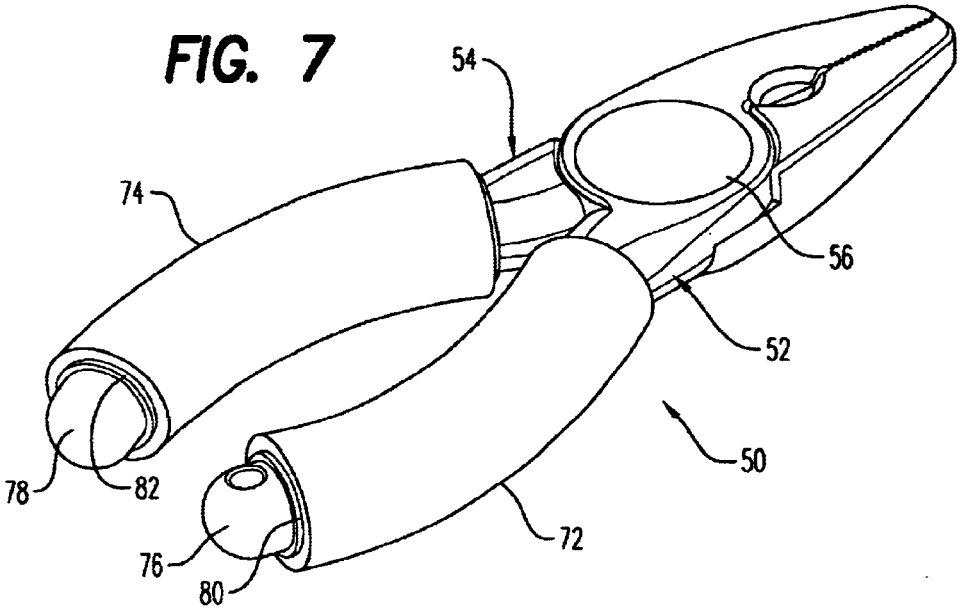
FIG. 7 is a perspective view of the invention of FIG. 5.
Figure 8:
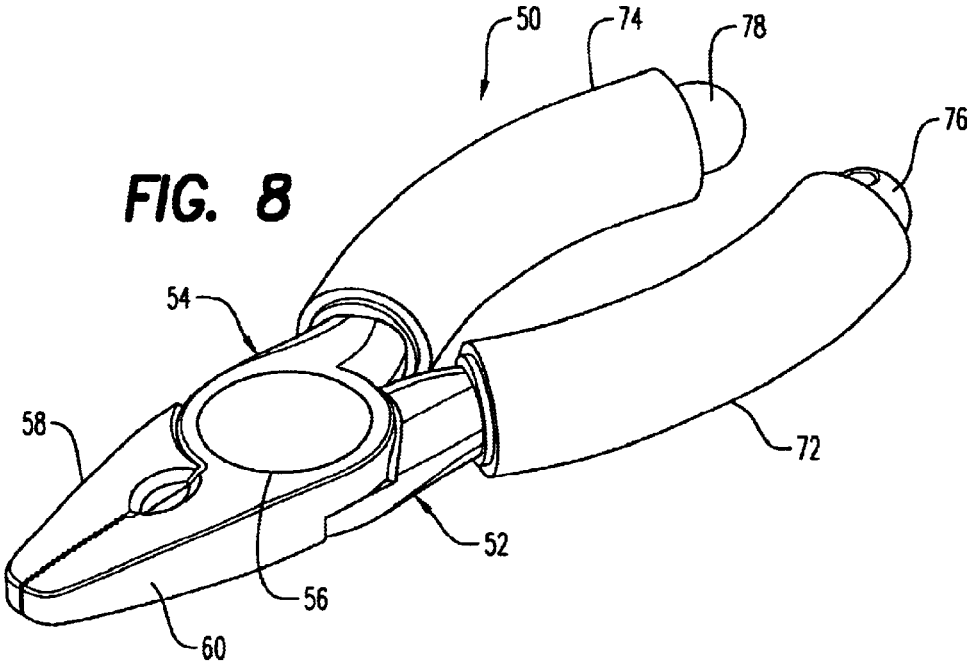
FIG. 8 is another perspective view of the invention of FIG. 5.
Figure 9:
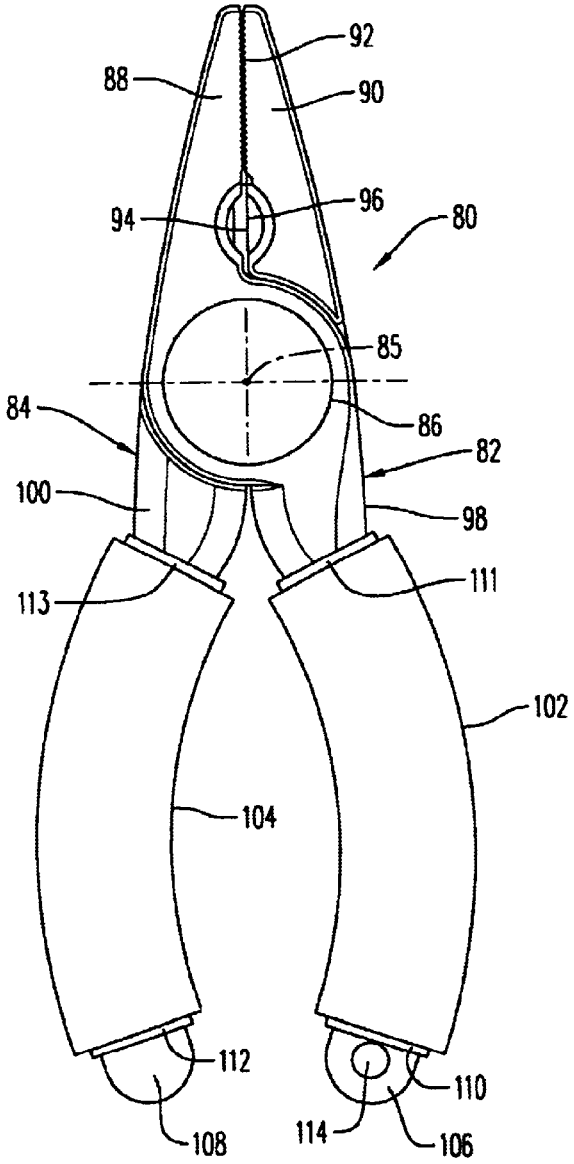
FIG. 9 is a front elevation view of still another embodiment of the invention.
Figure 10:
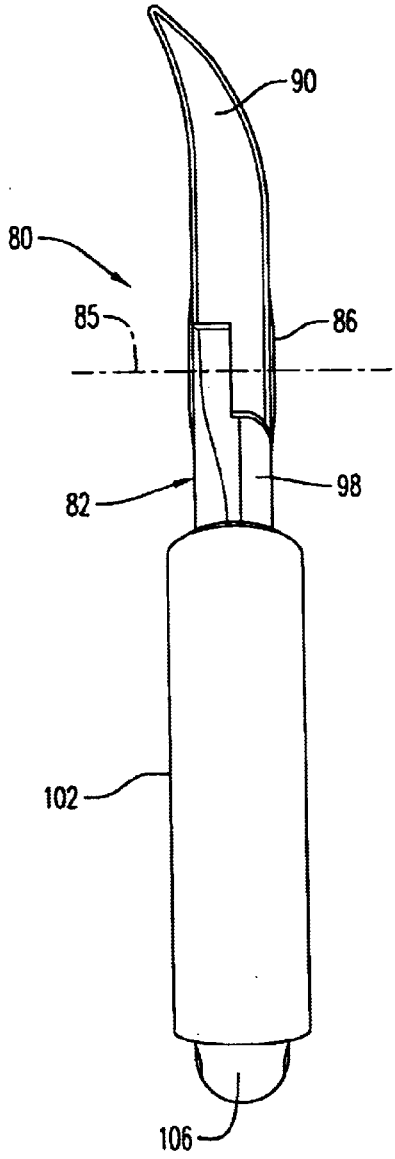
FIG. 10 is a side elevation view of FIG. 9.
Figure 11:
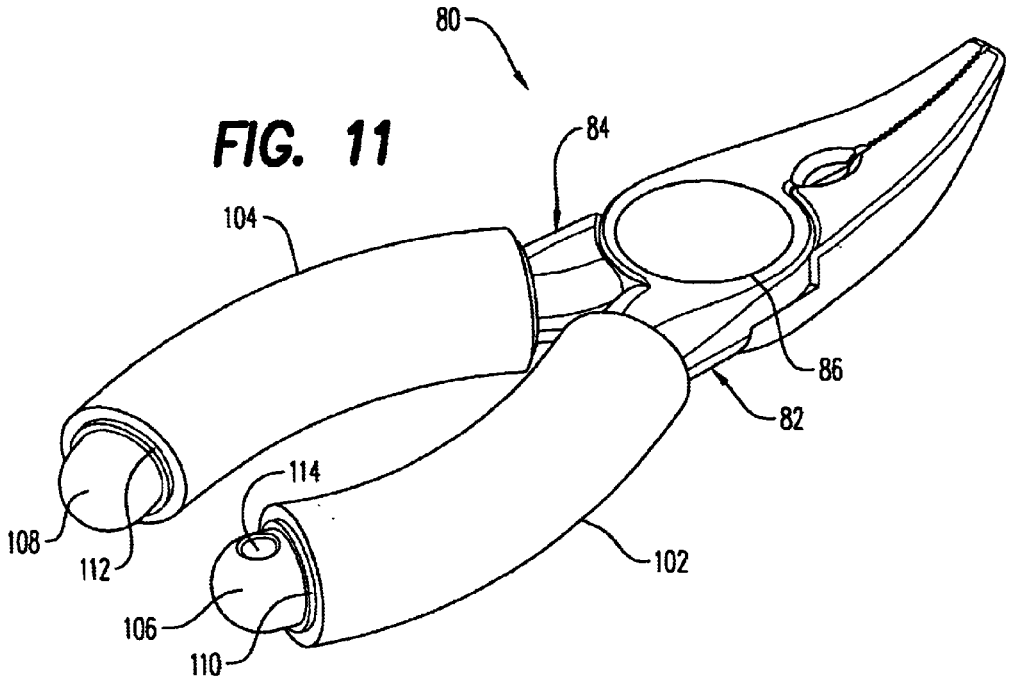
FIG. 11 is a perspective view of the invention of FIG. 9.
Figure 12:
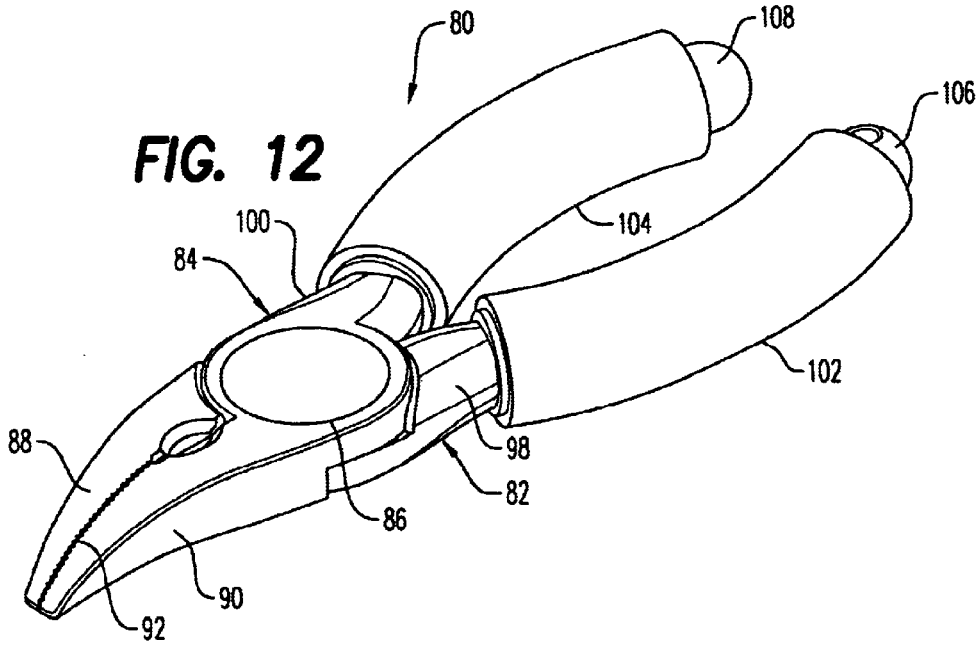
FIG. 12 is another perspective view of the invention of FIG. 9.

Referring now to the drawings, and particularly to FIGS. 1 to 4, one embodiment of the invention is there shown generally at numeral 10. This embodiment 10 is in the form of a pair of pliers having elongated handle portions 28 and 30 and shorter jaw portions 18 and 20, each forming respective end portions of lever members 12 and 14, respectively.

The two lever members 12 and 14 are pivotally connected together at their central overlapping portions about a pivotal axis 15. A retaining cap 16, described herebelow secures the two lever members 12 and 14 together. These components are formed of molded plastic or fiberglass material generally, and are preferably formed of a 43% glass fiber reinforced NYLON produced by Polyplastics Celanese, Nylon PA-66, Material No. 1603-2 having a relatively low density of 1.47 g/cc. The mating facing surfaces 22 of each of the jaw portions 18 and 20, respectively, are serrated or grooved for enhanced gripping of objects therebetween when the handle portions 28 and 30 are first opened, then placed around an object and then squeezed for retention within the jaw portions 18 and 20 in a well-known manner.

A cutting blade 24 is secured within jaw portion 18 which is aligned with and generally bears against the mating flat facing surface 26 of jaw portion 20 to effect cutting of material objects in a conventional manner.

Each of the handle portions 28 and 30 are substantially covered by tubular low-density sleeves 32 and 34. Each of these sleeves 32 and 34 are formed of ethylene vinyl acetate (EVA) having a wall thickness of approximately 0.12" and a density of approximately 0.12 g/cc. This foam material is of a dosed cell design for air tightness and lightweight characteristics.

Each of the handle portions 28 and 30 include stops or flanges 46 and 48 which limit the longitudinal movement of the sheaths 32 and 34 when installed over the handle portions 28 and 30 and also include enlarged flanges 40 and 42 which are accurately positioned adjacent the distal ends 36 and 38 and accurately spaced from flanges 46 and 48, respectively, so as to prevent off movement of the sheaths 32 and 34 during use. A lanyard aperture 44 is provided in one of the distal ends 36. By this arrangement, once each of the sheaths 32 and 34 are slidably installed onto the handle portions 28 and 30, respectively, the flanges 46, 48, 40 and 42 prevent any further longitudinal movement along the handle portions 28 and 30.

Another embodiment of the invention is shown generally at numeral 50 in FIGS. 5 to 8. This embodiment 50 is of a shorter, stubbier nature in proportion; however, construction is very similar to that above described in FIGS. 1 to 4. Each of the lever members 52 and 54 include jaw portions 58 and 60 which come together at mating serrated surfaces 62 for gripping objects therebetween. A cutting blade 64 bearing against flat surface 66 functions as previously described to cut objects. Pivotal engagement about the central pivot axis 55 is secured by retaining cap 56.

Foam low-density sheaths 72 and 74 have been slidably engaged over the handle portions 68 and 70 of each corresponding lever member 52 and 54, respectively. Flanges 80, 82, 140 and 142 prevent axial or longitudinal movement of each of the foam sheaths 72 and 74 during use.

The material selections used to mold each of the lever members 52 and 54 is as above described while the foam sheaths 72 and 64 are similarly constructed as shown and described in FIGS. 1 to 4. The distal end portions 76 and 78 are somewhat semi-spherical in configuration and include a lanyard aperture 84 formed into one distal portion 76 for convenient carrying.

In FIGS. 9 to 12, still another embodiment of the invention is there shown generally at numeral 80. This embodiment is also of a shorter, stubbier nature in proportion and includes arcuately curved jaw portions 88 and 90 and shorter, stubbier handle portions 98 and 100 of each of the lever members 82 and 84, respectively. The lever members 82 and 84 are pivotally connected at their central overlapping portions about a pivotal axis 85 and secured together by a retaining cap 86. Jaw portions 88 and 90 include serrated mating surfaces 92 and cutting edge 96 bearing against flat surface 94 as previously described. Foam low-density sheaths 102 and 104 have been slidably engaged over each of the handle portions 98 and 100 and are maintained from further axial movement during use by flanges 110, 112, 111 and 113. These sheaths 102 and 104 are formed of the above described foam material as with respect to FIGS. 1 to 4, as are the lever members 82 and 84. A lanyard aperture 114 in one of the two distal end portions 106 and 108 of the handle portions 98 and 100, respectively provides carrying facility.

Buoyancy in Water

Figure 18:
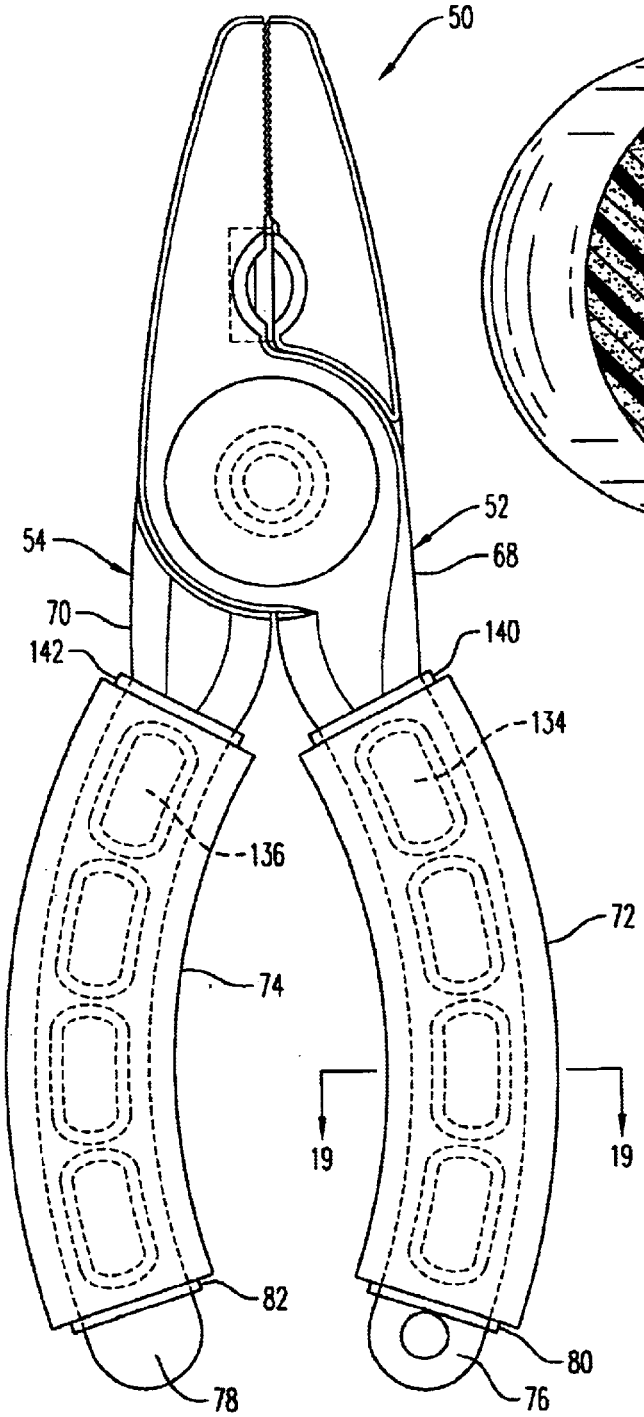
FIG. 18 is a view of the invention as shown in FIG. 5 with added hidden detail thereof particularly with respect to the handle portions.
Figure 19:
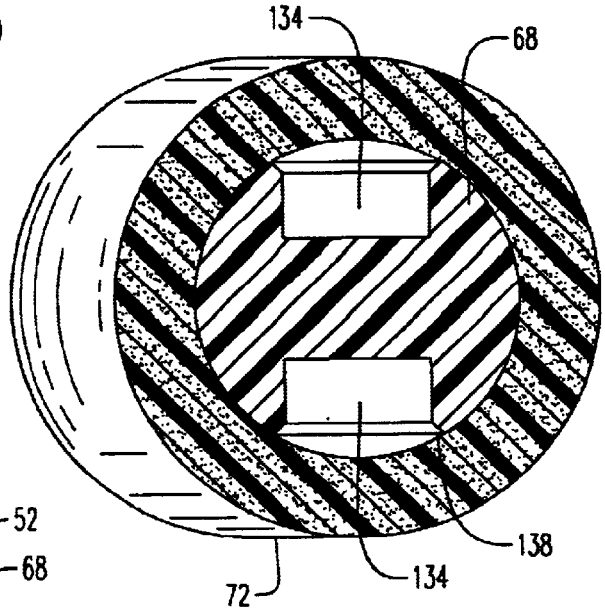
FIG. 19 is an enlarged section view in the direction of arrows 19—19 in FIG. 18.
Figure 20:
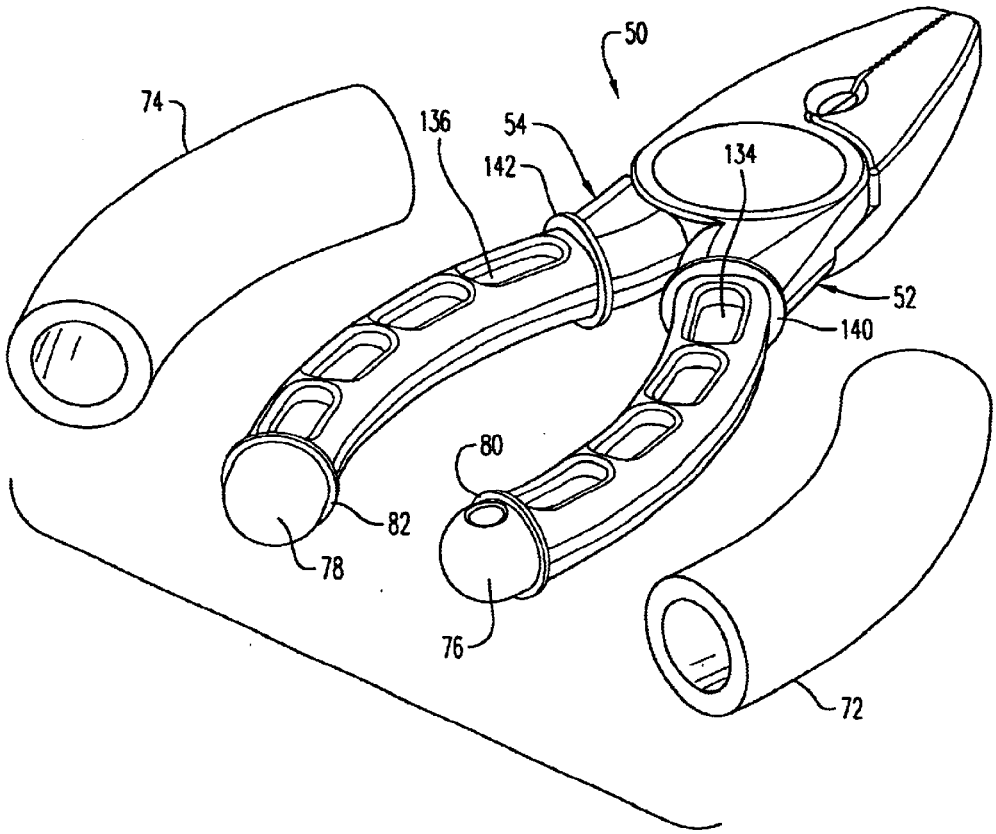
FIG. 20 is a perspective exploded view of the invention as shown in FIG. 5.

One of the most important features of the invention, that being buoyancy in water, is achieved as shown in FIGS. 18 to 20. The essence of the buoyancy of this invention is achieved through the combination of very light weight low density closed-cell foam material selected in the manufacture of each of the sheaths 72 and 74, in combination with the overall size and dimensions thereof and a series of one or more properly sized cavities 34 and 36 which are formed into the side surfaces of each of the handle portions 68 and 70.

As each of these sheaths 72 and 74 are assembled onto the handle portions 68 and 70 between flanges 80, 82, 140 and 142, each of cavities 134 and 136 are automatically sealed closed as best seen in FIG. 19. These cavities 134 and 136 are formed in open fashion into the side surfaces of each of the handle portions 68 and 70 such that, when the tightly fitting sheaths 72 and 74 formed of somewhat elastic material are slidably assembled onto the handle portions 68 and 70, the airtight sealing of these cavities 134 and 136 is achieved. Note additionally that the size of each of these cavities 134 and 136 is effectively enlarged outwardly due to the fact that the actuate configuration of the inner surface of the foam sleeves 72 and 74 extends outwardly from the open perimeter of the cavity 134 and 136.

Note further that, in the preferred embodiment shown, a plurality of cavities 134 and 136 are formed into the side surfaces in opposing inward directions of each of the handle portions 68 and 70. Thus, as best seen in FIG. 19, a somewhat "H"-shaped section is produced with sufficient plastic material utilized to form the web or central part of the "H"-shaped section of handle portions 68 and 70 for further increased depth of each of these cavities 134 and 136 toward the central plane of each of the handles 68 and 70 if desired for added buoyancy Moreover, by providing multiple cavities 134 and 136 extending in end-to-end fashion on either side surface of each of the handle portions 68 and 70, should one of the sheaths 72 or 74 be punctured or cut to the extent that water is allowed to enter into and flood one or more of the cavities, only a small portion of the buoyancy of the pliers 50 results from such a breach of air-tight status.

An example utilizing the embodiment of the invention shown in FIGS. 5 to 8 is here provided. The pair of pliers 50, having an overall length of 6½", have the following additional physical characteristics:

Total weight of plastic material: (3 pcs.): 59.95 g.

Total volume of plastic (3 pcs.): 39.43 cc.

Total weight of foam sheaths (2 pcs): 3.19 g.

Total volume of foam sheaths (2 pcs): 26.62 cc.

Total volume of trapped air within the cavities 134 and 136 collectively: (16 cavities): 4.50 cc.

When formed based upon the above described plastic material having a density of 1.47 g/cc and a foam material having a density of 0.12 g/cc, the effective density of the entire assembly 50 was less than 1.0 g/cc, sufficient to establish buoyancy in water.

Although it is preferred to have approximately 16 to 20 individual cavities which become fully airtight and water impervious upon installation of the tubular sheaths onto the handle portions as above described, it should be understood that one elongated open cavity formed into one or both sides of one or both of the handle portions which has a sufficiently trapped air tight volume to establish the overall buoyancy in water of the pair of pliers in combination with the above described foam sheaths is within the scope of this invention.

Restricted Opening Movement

Figure 13:
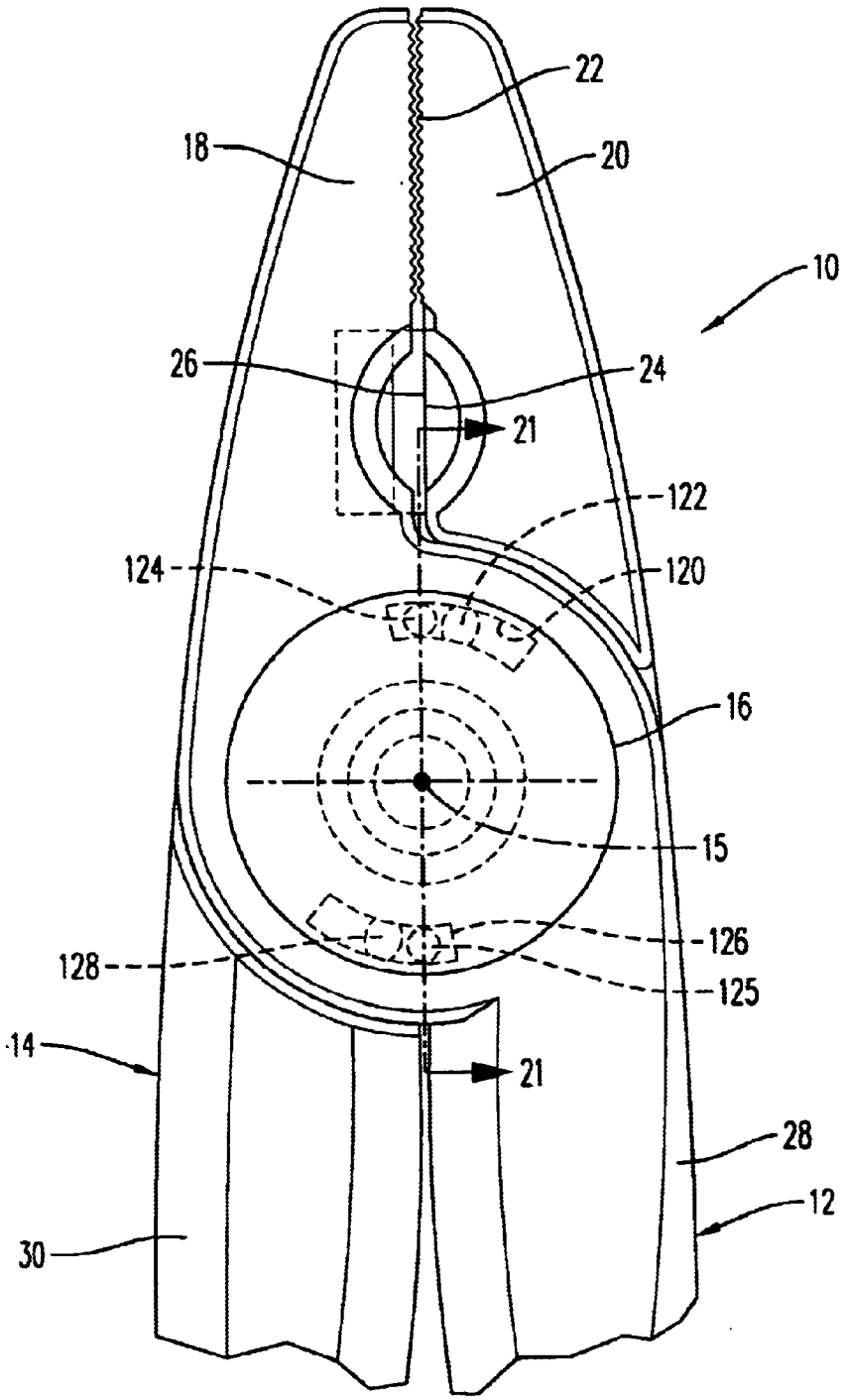
FIG. 13 is an enlarged view of the central pivot portion and jaw portion in a closed position thereof of the invention of FIG. 1.
Figure 14:
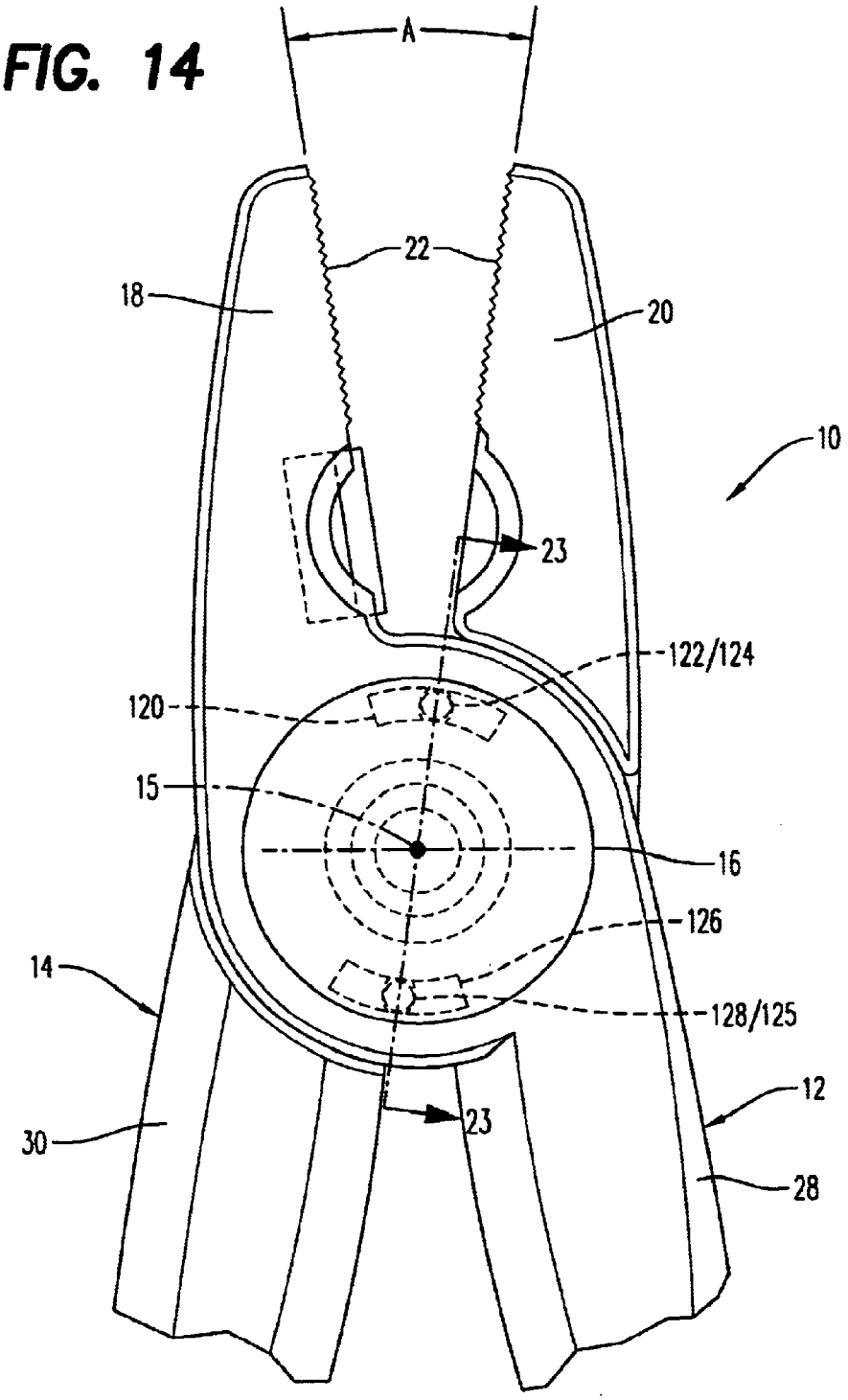
FIG. 14 is a view similar to that of FIG. 13 showing the jaw portions in a partially opened position.
Figure 15:
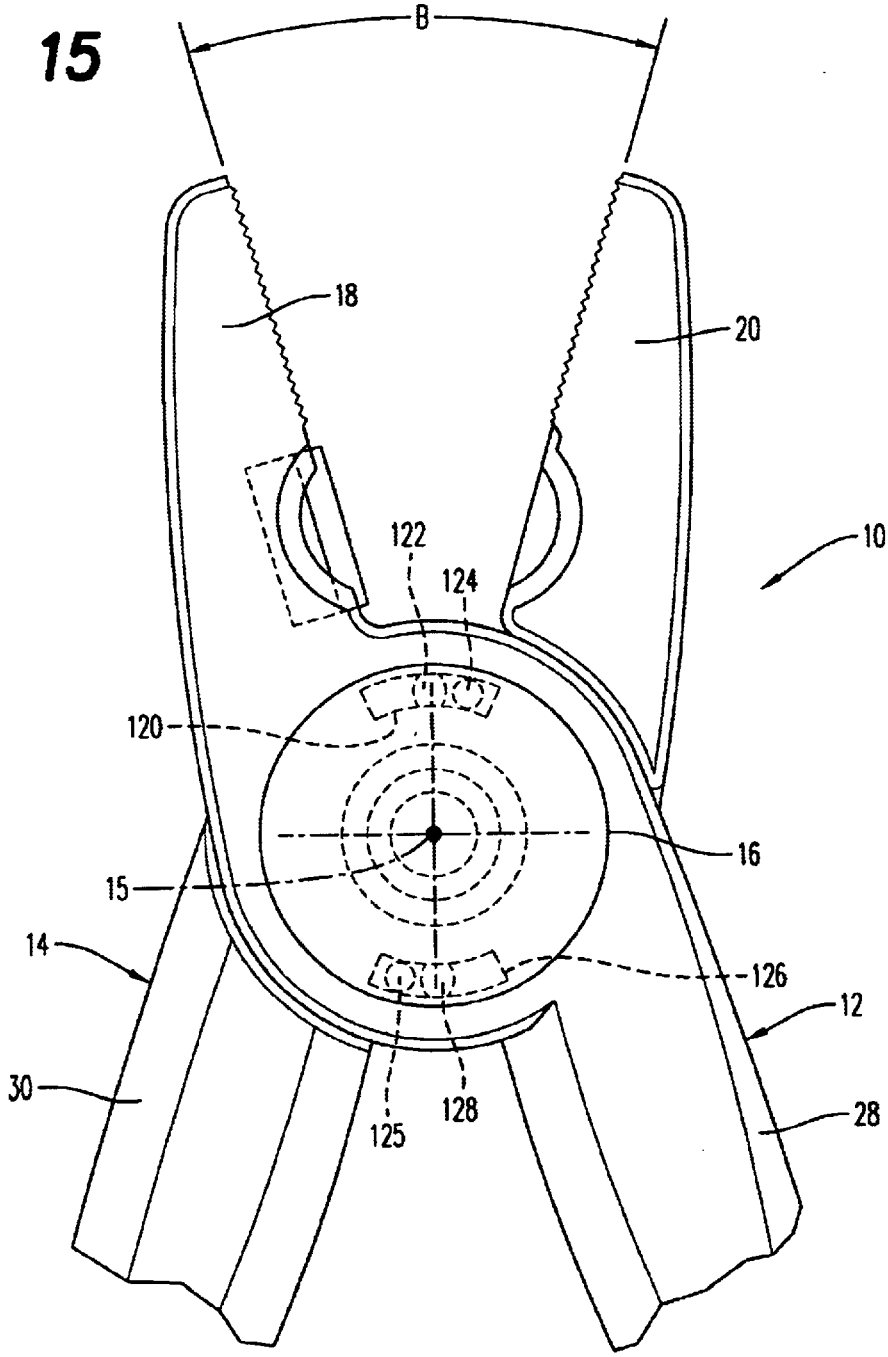
FIG. 15 is a view similar to FIG. 14 showing the jaws in a fully opened position.

A second important feature of the invention is with respect to the prevention of detrimental, excess opening of the pair of pliers to facilitate grasping and squeezing an object between the jaw portions which is too large for the overall strength of the lever members of the device. This aspect of the invention is seen in FIGS. 13 to 16 and 21 to 24. In the preferred embodiment of this aspect of the invention, two features related to the opening movement of each of the lever members 12 and 14, from the dosed position as shown in FIG. 13, to the partially open position shown in FIG. 14 to the fully opened position shown in FIG. 15, are provided. These features include both a resistive "felt" detent advising the user that the maximum limit of opening of the jaw portions 18 and 20 as seen in FIG. 14 in the direction of arrow A, has been achieved. Thereafter, as the user approaches a maximum opening limit in the direction of arrow B in FIG. 15, a positive limitation from further opening movement is provided as will be described more fully herebelow.

Figure 16:
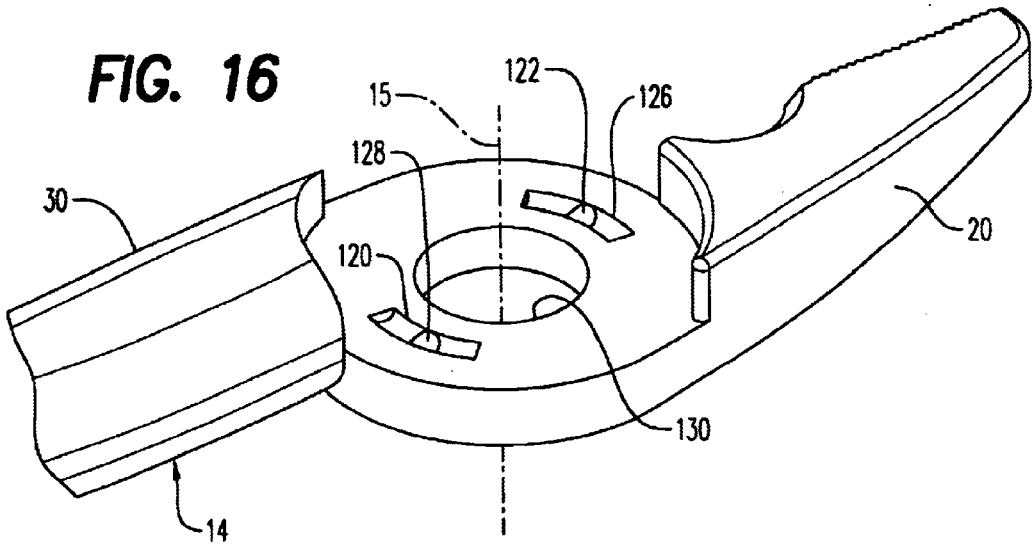
FIG. 16 is a perspective view of the jaw portion and central pivot portion of one of the lever members of FIG. 1.
Figure 17:
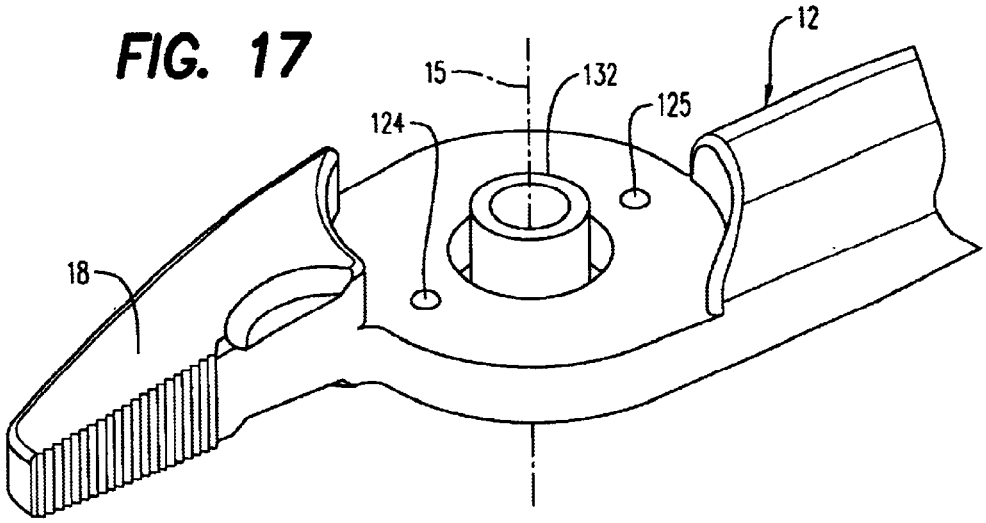
FIG. 17 is a perspective view of the jaw and central portion of the other lever member of FIG. 1.
Figure 22:
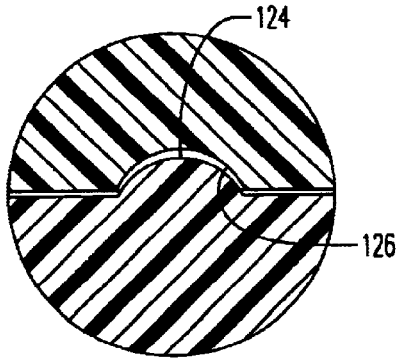
FIG. 22 is an enlargement of area 22 in FIG. 21.
Figure 21:
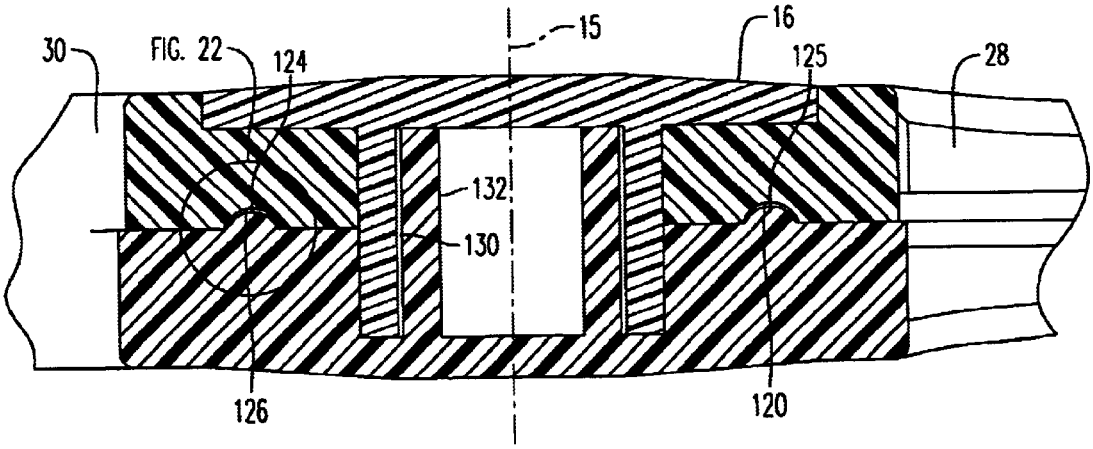
FIG. 21 is an enlarged section view in the direction of arrows 21—21 in FIG. 13.
Figure 24:
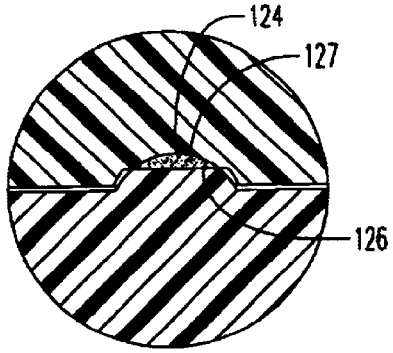
FIG. 24 is an enlargement of area 24 in FIG. 23.

As seen in FIG. 16, one of the lever arms 14 includes within its central portion between jaw portions 20 and handle portion 30, a central enlarged aperture 130 and two radially outwardly positioned arcuate cavities 120 and 126. These cavities 120 and 126 are concentric about the pivotal axis 15 defined by aperture 130. The radial configuration of each of these arcuate cavities 120 and 126 is semi-circular in cross section as best seen in FIGS. 22 and 24 as described more fully herebelow.

Disposed within each of these cavities 120 and 126 are detent bumps or raised areas 122 and 128. These detent bumps 122 and 128 may be positioned symmetrically anywhere along the arcuate length of each of these cavities 120 and 126 as desired to achieve the effect of notifying a user by feel that the maximum opening of the jaw portions 18 and 20 is being approached and should not be exceeded.

The other of the lever members 12 includes a cylindrical protruding bearing portion 132 which closely mates within the cylindrical bearing aperture 130 to achieve the desired smooth pivotal opening and closing movement of the device 10. The enlarged retaining cap 16 lockably engages within the inner bore of pivotal bearing 132 to lockably secure the entire pivotal connection together.

Projecting from the facing surface of the central portion of lever member 12 are two semi-spherical projections 124 and 125. When assembled as best seen in FIGS. 21 to 24, these spherical projections 124 and 125 ride along within the arcuate cavities 126 and 120, respectively, in closely aligned fashion as best seen in FIG. 22.

However, as the jaw portions 18 and 20 approach the preselected angular orientation A of the lever members 12 and 14 as shown in FIG. 14, the spherical projections 124 and 125 encounter the detent bumps 126 and 120, respectively, which are cooperatively sized to cause a degree of interference therebetween. This amount of interference is best seen in FIGS. 23 and 24 at 127.

Because of the plastic material selection, although generally of a tough and durable nature, a small amount of compression and deflection will occur within this interference zone 127 whereby the lever members 12 and 14 may be opened further toward angle B in FIG. 15, the maximum allowable opening of the jaw portions 18 and 20 whereupon the spherical projections 124 and 125 come to bear against the corresponding ends of each of the arcuate cavities 120 and 126.

Figure 23:
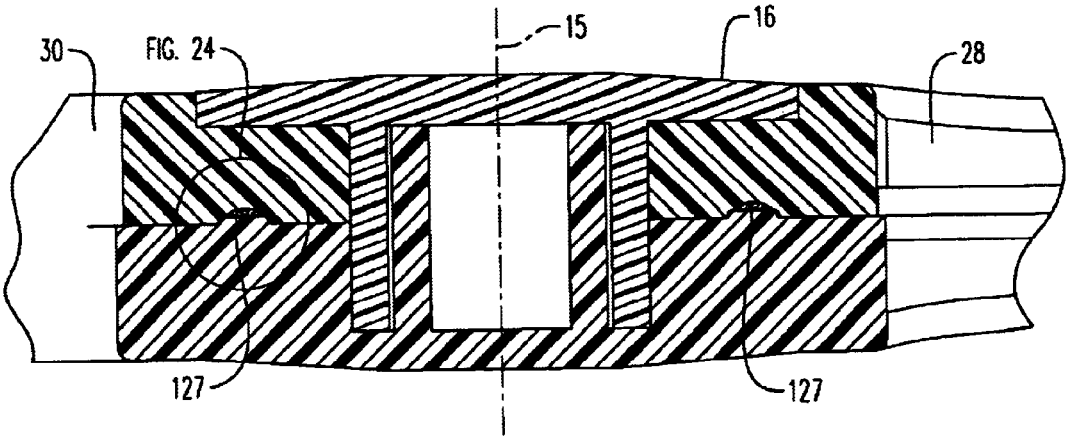
FIG. 23 is a section view in the direction of arrows 23—23 in FIG. 14.

As can be seen in FIGS. 23 and 24, the height of each of the detent bumps 124 and 125 is preselected to be slightly less than the mating depth of each of the arcuate cavities 120 and 126 whereby the amount of interference at 127 may be regulated. Obviously, the greater the interference, the greater the detent feel which will be felt by the user as this angular orientation of the lever members 12 and 14 is encountered.

Moreover, the placement of each of these detent bumps 122 and 128 in their angular orientation about the pivotal axis 15 may also be varied. The angular opening position A in FIG. 14 may thus easily be varied as desired to be centrally positioned as shown or more closely positioned to the maximum opening position B in FIG. 15 so that the user has a clear felt indication that further opening of the jaw portions 18 and 20 to grasp an object too large to be dealt with by the device 10 is achieved.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pair of non-conductive substantially buoyant-in-water hand pliers comprising:

a pair of elongated substantially non-conductive lever members each having a handle portion and a jaw portion, said lever members pivotally connected together at a central portion between said jaw and handle portion of each said lever members;

each said handle portion having a plurality of separate outwardly opening cavities formed into opposing side surfaces defined by generally H-shaped transverse cross section segments of said handle portions;

an elongated tubular sheath formed of material buoyant in water and extending over and enclosing said cavities in airtight fashion, said sheaths cooperating to render said pliers substantially buoyant in water.

2. A pair of non-conductive substantially buoyant-in-water hand pliers as set forth in claim 1, wherein:

each said sleeve has a density of about 0.1 g/cc, the density of said lever members is about 1.3 to 1.6 g/cm, and the total volume of air trapped in said cavities is in the range of 4 to 5 cc.

3. A pair of non-conductive substantially buoyant-in-water hand pliers as set fort in claim 1, wherein:

said lever members are formed substantially of plastic or fiberglass.

4. A pair of non-conductive substantially buoyant-in-water hand pliers as set forth in claim 1, wherein:

said lever members are formed of fiberglass reinforced NYLON material.

5. A pair of non-conductive substantially buoyant-in-water hand pliers as set forth in claim 1, wherein:

said sheaths are formed of closed cell foam maternal.

6. A pair of non-conductive substantially buoyant-in-water hand pliers as set forth in claim 1, wherein:

said sheaths are formed of ethylene vinyl acetate having a density of about 0.12 g/cc.

7. A pair of non-conductive substantially buoyant-in-water hand pliers as set forth in claim 1, further comprising:

a restraining detent providing felt indicia limiting opening pivotal movement between said jaw portions whereby the possibility of damage to said lever members resulting from applying gripping force against an object exceeding a pre-determined size around which said Jaw portions are fitted is minimized.

8. A pair of non-conductive substantially buoyant-in-water hand pliers as set forth in claim 1, wherein:

full pivotal opening movement between said Jaw portions is limited to reduce likelihood of lever member damage.

9. A pair of non-conductive substantially buoyant-in-water hand pliers as set forth in claim 1, further comprising, a detent positioned between said central portions providing felt indcia during jaw portion opening movement at a midpoint of lever member pivotal movement.

10. A pair of non-conductive substantially buoyant-in-water hand pliers comprising:

a pair of elongated substantially non-conductive lever members each having a handle portion and a jaw portion, said lever members pivotally connected together at a central portion between said jaw and handle portion of each said lever members;

each said handle portion having an enlarged stop positioned in spaced relation from the pivotal connection and an elongated open cavity formed into a side surface thereof extending from a distal end of said handle portion toward said stop;

an elongated tubular sheath formed of material buoyant in water and extending over and enclosing said cavities in airtight fashion, each said sheath ending at said respective stop and cooperating to render said pliers substantially buoyant in water.

11. A pair of non-conductive substantially buoyant-in-water hand pliers as set forth in claim 10, wherein:

each said sleeve has a density of about 0.1 g/cc, the density of said lever members is about 1.3 to 1.6 g/cm, and the total volume of air trapped in said cavity is in the range of 4 to 5 cc.

12. A pair of non-conductive substantially buoyant-in-water hand pliers as set forth in claim 10, wherein:

said lever members are formed substantially of plastic or fiberglass.

13. A pair of non-conductive substantially buoyant-in-water hand pliers as set forth in claim 10, wherein:

said lever members are formed of fiberglass reinforced NYLON material.

14. A pair of non-conductive substantially buoyant-in-water hand pliers as set forth in claim 10, wherein:

said sheaths are formed of closed cell foam material.

15. A pair of non-conductive substantially buoyant-in-water hand pliers as set forth in claim 10, wherein:

said sheaths are formed of ethylene vinyl acetate having a density of about 0.12 g/cc.

16. A pair of non-conductive substantially buoyant-in-water hand pliers as set forth in claim 10, further comprising:

a restraining detent providing felt indicia limiting opening pivotal movement between said jaw portions whereby the possibility of damage to said lever members resulting from applying gripping force against an object exceeding a pre-determined size around which said jaw portions are fitted is minimized.

17. A pair of non-conductive substantially buoyant-in-water hand pliers as set forth in claim 10, wherein:

full pivotal opening movement between said jaw portions is limited to reduce likelihood of lever member damage.

18. A pair of non-conductive substantially buoyant-in-water hand pliers as set forth in claim 10, further comprising:

a detent positioned between said central portions providing felt indicia during jaw portion opening movement at a midpoint of lever member pivotal movement.

19. A pair of noninductive substantially buoyant-in-water hand pliers comprising:

a pair of elongated substantially non-conductive lever members each having a handle portion and a jaw portion, said lever members pivotally connected together at a central portion between said jaw and handle portion of each said lever members;

each said handle portion having a plurality of separate outwardly opening cavities formed into opposing side surfaces defined by generally H-shaped transverse cross section segments of said handle portion;

an elongated tubular sheath formed of material buoyant in water and covering and sealingly enclosing each of said cavities whereby the effective density of said pliers to less than that of water.

20. A pair of non-conductive substantially buoyant-in-water hand pliers as set forth in claim 19, wherein:

the density of each said sleeve has a density of about 0.1 g/cc, the density of said lever members is about 1.3 to 1.6 g/cm and the total volume of air trapped in said cavities is in the range of 4 to 5 cc.

21. A pair of non-conductive substantially buoyant-in-water hand pliers as set forth in claim 19, wherein:

said lever members are formed substantially of plastic or fiberglass.

22. A pair of non-conductive substantially buoyant-in-water hand pliers as set forth in claim 19, wherein:

said lever members are formed of fiberglass reinforced NYLON material.

23. A pair of non-conductive substantially buoyant-in-water hand pliers as set forth in claim 19, wherein:

said sheaths are formed of closed cell foam material.

24. A pair of non-conductive substantially buoyant-in-water hand pliers as set forth in claim 19, wherein:

said sheaths are formed of ethylene vinyl acetate having a density of about 0.12 g/cc.

25. A pair of non-conductive substantially buoyant-in-water hand pliers as set forth in claim 19, further comprising:

a restraining detent providing felt indicia limiting opening pivotal movement between said jaw portions whereby the possibility of damage to said lever members resulting from applying gripping force against an object exceeding a pre-determined size around which said jaw portions are fitted is minimized.

26. A pair of non-conductive substantially buoyant-in-water hand pliers as set forth in claim 19, wherein:

full pivotal opening movement between said jaw portions is limited to reduce likelihood of lever member damage.

27. A pair of non-conductive substantially buoyant-in-water hand pliers as set forth in claim 19, further comprising:

a detent positioned between said central portions providing felt indicia during jaw portion opening movement at a midpoint of lever member pivotal movement.

* * * * *